US009091131B2

(12) United States Patent
Yu et al.

(10) Patent No.: US 9,091,131 B2
(45) Date of Patent: Jul. 28, 2015

(54) HIGH DIAMOND FRAME STRENGTH PCD MATERIALS

(76) Inventors: Feng Yu, Lindon, UT (US); J. Daniel Belnap, Lindon, UT (US)

( * ) Notice: Subject to any disclaimer, the term of this patent is extended or adjusted under 35 U.S.C. 154(b) by 548 days.

(21) Appl. No.: 13/449,641

(22) Filed: Apr. 18, 2012

(65) Prior Publication Data

US 2012/0261196 A1 Oct. 18, 2012

Related U.S. Application Data

(60) Provisional application No. 61/476,696, filed on Apr. 18, 2011.

(51) Int. Cl.
*E21B 10/46* (2006.01)
*E21B 10/55* (2006.01)

(52) U.S. Cl.
CPC ..... *E21B 10/46* (2013.01); *E21B 10/55* (2013.01)

(58) Field of Classification Search
CPC ... E21B 10/46; E21B 10/55; E21B 2010/545; E21B 10/567
See application file for complete search history.

(56) References Cited

U.S. PATENT DOCUMENTS

| | | | | |
|---|---|---|---|---|
| 5,304,342 | A | 4/1994 | Hall | |
| 2006/0060390 | A1 * | 3/2006 | Eyre | 175/432 |
| 2006/0060391 | A1 * | 3/2006 | Eyre et al. | 175/434 |
| 2009/0152017 | A1 * | 6/2009 | Shen et al. | 175/432 |
| 2010/0084197 | A1 * | 4/2010 | Voronin et al. | 175/428 |
| 2010/0122853 | A1 | 5/2010 | Scott et al. | |
| 2010/0294571 | A1 | 11/2010 | Belnap | |
| 2010/0307070 | A1 | 12/2010 | Bertagnolli | |
| 2011/0024201 | A1 | 2/2011 | Scott et al. | |
| 2011/0132667 | A1 | 6/2011 | Smallman | |
| 2011/0176879 | A1 * | 7/2011 | Jonker et al. | 408/144 |

OTHER PUBLICATIONS

International Search Report and Written Opinion of PCT Application No. PCT/2012/034002 dated Jan. 21, 2013: pp. 1-14.

* cited by examiner

*Primary Examiner* — Cathleen Hutchins

(57) ABSTRACT

The present disclosure relates to cutting elements incorporating polycrystalline diamond bodies used for subterranean drilling applications, and more particularly, to polycrystalline diamond bodies having high diamond frame strength and methods for forming and evaluating such polycrystalline diamond bodies. A polycrystalline diamond body is provided, having a top surface, a cutting edge meeting the top surface, and a first region including at least a portion of the cutting edge. The first portion exhibits a diamond frame strength of about 1200 MPa or greater, or about 1300 MPa or greater.

26 Claims, 12 Drawing Sheets

HIGH DIAMOND FRAME STRENGTH PCD MATERIALS

CROSS-REFERENCE TO RELATED APPLICATION(S)

This application claims priority to and the benefit of U.S. Provisional Application No. 61/476,696, filed Apr. 18, 2011, titled "High Strength Diamond Frame PCD Materials and Shear Cutters Having Cutting Edges Formed From Such Materials," the disclosure of which is incorporated by reference herein in its entirety.

BACKGROUND

Polycrystalline diamond (PCD) materials known in the art are formed from diamond grains (or crystals) and a catalyst material which are subjected to high pressure and high temperature conditions ("HPHT sintering process"). Such PCD materials are known for having a high degree of wear resistance, making them a popular material choice for use in such industrial applications as cutting tools for machining and wear and cutting elements in subterranean mining and drilling, where such high degree of wear resistance is desired. In such applications, conventional PCD materials can be provided in the form of a surface layer or body to impart desired levels of wear resistance to a cutting tool.

Traditionally, PCD cutting elements include a substrate and a PCD body or layer attached thereto. Substrates used in such cutting element applications include carbides such as a cemented tungsten carbide (e.g., WC—Co). Such conventional PCD bodies utilize a catalyst material to facilitate intercrystalline bonding between the diamond grains and to bond the PCD body to the underlying substrate. Metals conventionally employed as the catalyst are often selected from the group of solvent metal catalysts including cobalt, iron, nickel, combinations, and alloys thereof.

The amount of catalyst material used to form the PCD body represents a compromise between desired properties of strength/toughness/impact resistance and hardness/wear resistance/thermal stability. While a higher metal catalyst content typically increases the strength, toughness, and impact resistance of a resulting PCD body, such higher metal catalyst content also decreases the hardness and corresponding wear resistance as well as the thermal stability of the PCD body. Thus, these inversely affected properties ultimately limit the ability to provide PCD bodies having desired levels of hardness, wear resistance, thermal stability, strength, impact resistance, and toughness to meet the service demands of particular applications, such as cutting and/or wear elements used in subterranean drilling devices.

A particularly desired property of PCD bodies used for certain applications is improved thermal stability during wear or cutting operations. A problem known to exist with conventional PCD bodies is that they are vulnerable to thermal degradation when exposed to elevated temperature cutting and/or wear applications. This vulnerability results from the differential that exists between the thermal expansion characteristics of the solvent metal catalyst material disposed interstitially within the PCD body and the thermal expansion characteristics of the intercrystalline bonded diamond. Such differential thermal expansion is known to start at temperatures as low as 400° C., and can induce thermal stresses that can be detrimental to the intercrystalline bonding of diamond and eventually result in the formation of cracks that can make the PCD structure vulnerable to failure. Accordingly, such behavior is not desirable.

Another form of thermal degradation known to exist with conventional PCD materials is one that is also related to the presence of the solvent metal catalyst in the interstitial regions of the PCD body and the adherence of the solvent metal catalyst to the diamond crystals. Specifically, the solvent metal catalyst is known to cause an undesired catalyzed phase transformation in diamond (converting it to carbon monoxide, carbon dioxide, or graphite) with increasing temperature, thereby limiting practical use of the PCD body to about 750° C.

Thermal degradation can lead to chipping, spalling, partial fracturing, and/or exfoliation of the PCD body. These problems can be caused by the formation of micro-cracks within the PCD body followed by propagation of the crack across the PCD body. Micro-cracks can form from thermal stresses occurring within the PCD body.

SUMMARY

The present disclosure relates to cutting elements incorporating polycrystalline diamond bodies used for subterranean drilling applications, and more particularly, to polycrystalline diamond bodies having a high diamond frame strength. In various embodiments disclosed herein, a cutting element with a polycrystalline diamond body having a high diamond frame strength has been found to correlate with improved wear resistance. Diamond frame strength is the strength of the polycrystalline diamond structure itself, without any secondary phase materials such as cobalt or other catalysts. Due to the behavior of such secondary phase materials at elevated temperatures, the strength of the polycrystalline diamond body with secondary phase materials has been determined not to correlate sufficiently with improved wear resistance in the field. As described in further detail below, the wear resistance of such cutting elements can be improved by increasing the diamond frame strength and reducing the secondary phase content in the polycrystalline diamond body.

In one embodiment, a cutting element includes a substrate and a polycrystalline diamond body formed over the substrate. The polycrystalline diamond body includes a top surface with a cutting edge. The polycrystalline diamond body has a material microstructure with bonded-together diamond crystals and interstitial regions between the diamond crystals. A region of the microstructure including the cutting edge has a diamond frame strength of about 1200 MPa or greater, or about 1300 MPa or greater, and has an average sintered grain size of less than 10 microns. In one embodiment, the cutting element is incorporated into a downhole tool.

In one embodiment, a method of forming a wear-resistant polycrystalline diamond cutting element is provided. The method includes providing a powder mixture having diamond particles with an average particle size of 20 microns or less. The method includes compacting the powder mixture to compress the diamond particles, and sintering the powder mixture and a catalyst material at high temperature and high pressure, in the range of 7.0 to 8.2 GPa. The sintering process forms a polycrystalline diamond body. A region of the polycrystalline diamond body has a microstructure with a diamond frame strength of at least 1200 MPa.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

Embodiments of high diamond frame strength PCD materials are described with reference to the following figures. The same numbers are used throughout the figures to reference like features and components.

DETAILED DESCRIPTION

Figure 1:
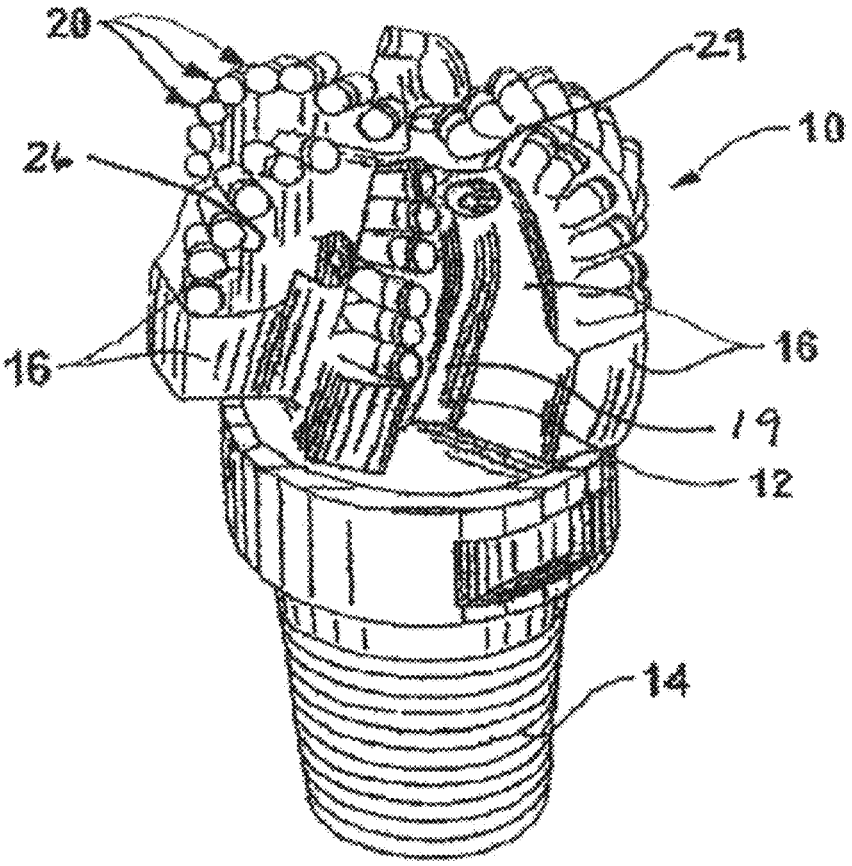
FIG. 1 is a perspective view of a drill bit incorporating a plurality of cutting elements according to an embodiment of the present disclosure.

The present disclosure relates to cutting elements incorporating polycrystalline diamond bodies used for subterranean drilling applications, and more particularly, to polycrystalline diamond bodies having high diamond frame strength and methods for forming and evaluating such polycrystalline diamond bodies.

The following disclosure is directed to various embodiments. The embodiments disclosed have broad application, and the discussion of any embodiment is meant only to be exemplary of that embodiment, and not intended to intimate that the scope of the disclosure, including the claims, is limited to that embodiment or to the features of that embodiment.

Certain terms are used throughout the following description and claims to refer to particular features or components. As one skilled in the art would appreciate, different persons may refer to the same feature or component by different names. This document does not intend to distinguish between components or features that differ in name only. The drawing figures are not necessarily to scale. Certain features and components herein may be shown exaggerated in scale or in somewhat schematic form and some details of conventional elements may not be shown in the interest of clarity and conciseness.

In the following description and in the claims, the terms "including" and "comprising" are used in an open-ended fashion, and thus, should be interpreted to mean "including, but not limited to."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also include individual numerals such as 2, 3, 4, and sub-ranges such as 1 to 3, 2 to 4, etc. The same principle applies to ranges reciting only one numerical value, such as "at most 4.5", which should be interpreted to include all of the above-recited values and ranges. Further, such an interpretation should apply regardless of the breadth of the range or the characteristic being described.

When using the term "different" in reference to materials used, it is to be understood that this includes materials that generally include the same constituents, but may include different proportions of the constituents and/or that may include differently sized constituents, wherein one or both operate to provide a different mechanical and/or thermal property in the material. The use of the terms "different" or "differ", in general, are not meant to include typical variations in manufacturing.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Referring to FIG. 1, a drill bit 10, specifically a fixed cutter drill bit, is shown. The drill bit 10 includes a bit body 12, which may be formed of a matrix material, such as a tungsten carbide powder infiltrated with an alloy binder material, or may be a machined steel body. The bit body 12 includes a threaded connection 14 at one end for coupling the bit 10 to a drilling string assembly (not shown). The bit body 12 also includes a bit face 29 having a cutting element support structure disposed thereon which, in this example, comprises a plurality of blades 16 extending from the surface of the bit body. Each of the blades 16 includes a plurality of cutter pockets 26 formed therein along the periphery to accept and support a cutting element 20 positioned therein. Drilling fluid flow courses 19 are disposed between adjacent blades.

Figure 2:
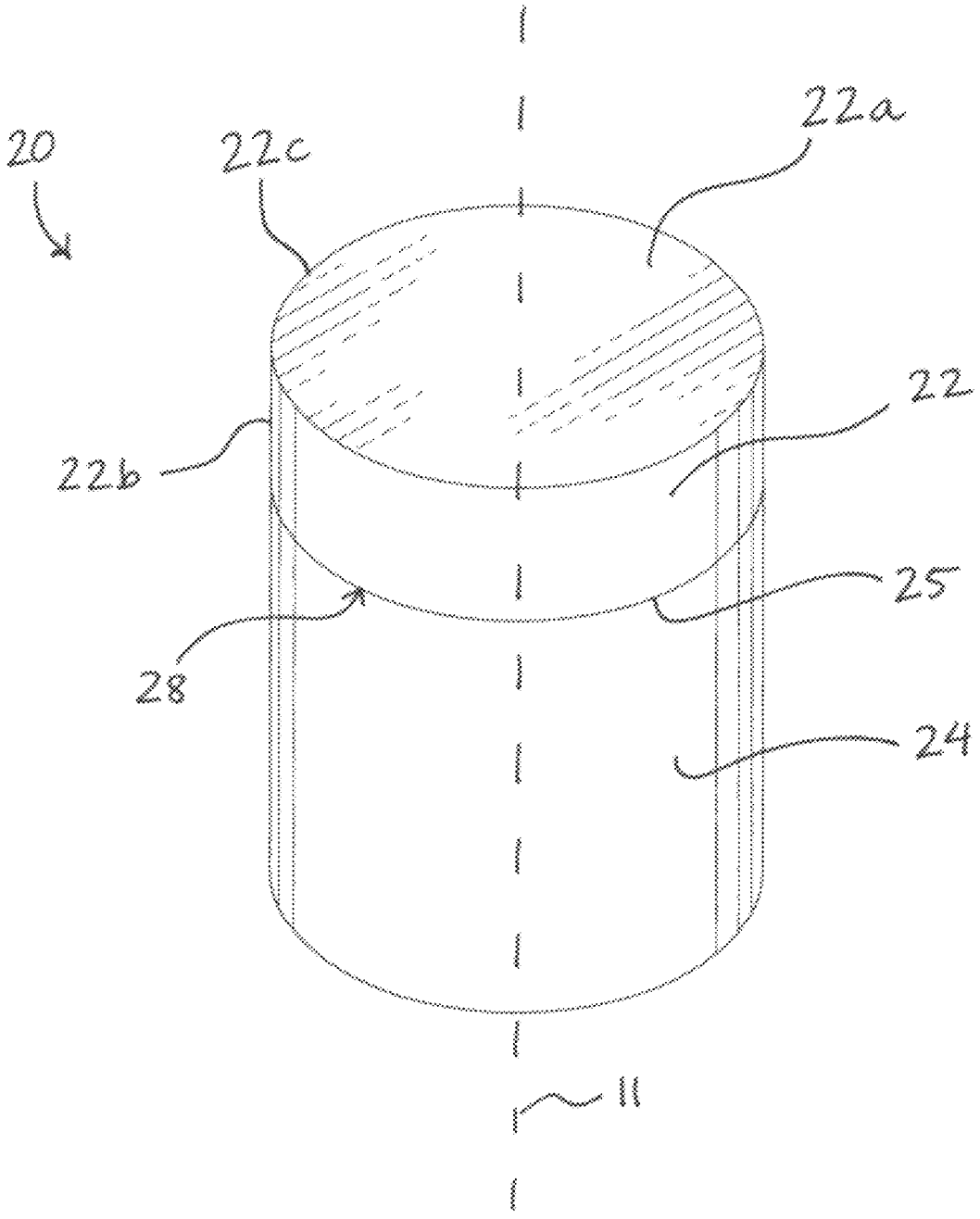
FIG. 2 is a perspective view of a cutting element including a PCD body and a substrate according to an embodiment of the present disclosure.

The cutting elements 20 may include polycrystalline diamond compact cutting elements, which may also be referred to as "PCD cutters", "shear cutters" or "cutters" 20. A perspective view of a cutting element 20 is shown, for example, in FIG. 2. Referring to FIG. 2, a PCD body 22 is bonded to a substrate material 24 to form the cutting element 20. The PCD body 22 has an upper surface 22*a* and a side surface 22*b*. The upper surface 22*a* meets the side surface 22*b* at a cutting edge 22*c*. The cutting edge is that portion of the cutting element which engages the formation during drilling. The cutting edge is illustrated in FIG. 2 as a sharp edge; however, in one or more alternative embodiments, the transition between the upper surface 22*a* and the side surface 22*b* may contain a beveled, curved, or tapered surface.

Alternatively, a PCD body may be created without a substrate, and optionally may be bonded to a substrate after HPHT sintering, or may be incorporated into a cutting tool without the use of a substrate. Catalyst material may be added to the diamond powder mixture prior to sintering.

The PCD body 22 is sometimes referred to as a diamond body, diamond table or abrasive layer. The PCD body 22 contains a microstructure of randomly oriented diamond crystals bonded together to form a diamond matrix phase and a plurality of interstitial regions interposed between the diamond crystals. The lower surface 25 of the PCD body 22 and the upper surface of the substrate 24 form the interface 28. The cutting element 20 has a central longitudinal axis 11. The cutting element illustrated in FIG. 2 is depicted as cylindrical; however, it is to be understood that any other shape may be suitable, such as ovoid, elliptical, etc., and these other shapes are contemplated as being within the scope of the present disclosure. In one or more other embodiments, the cutting element 20 may be used without a substrate 24. In one or more embodiments, the PCD body has an average thickness (between the lower surface 25 and the upper surface 22*a*) of at least 1.0 mm, suitably at least 1.5 mm, more suitably at least 2 mm, most suitably in the range of from 1.5 mm to 5 mm, for example 2.25 mm, 2.5 mm, 2.75 mm, 3 mm, 3.25 mm, 3.5 mm, or 4 mm.

Figure 3A:
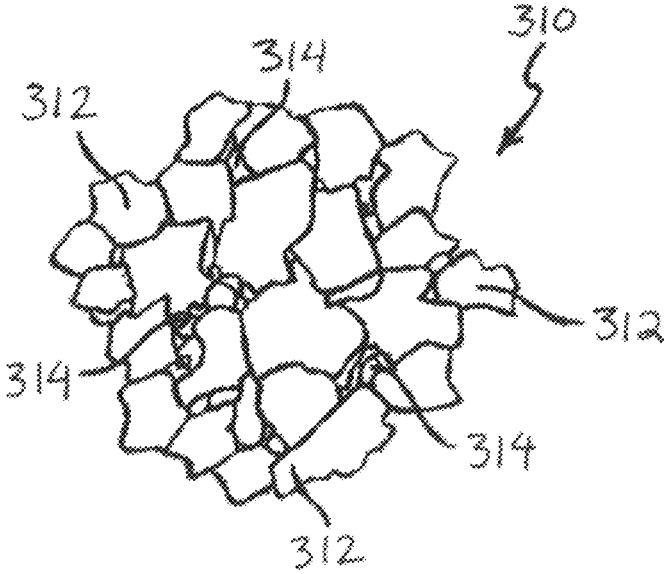
FIG. 3A is schematic representation of a region of a PCD body including a catalyst material.

FIG. 3A schematically illustrates a region 310 of a PCD body that includes a catalyst material. In particular, the region 310 comprises a plurality of bonded together diamond crystals 312, forming an intercrystalline diamond matrix first phase, and catalyst material 314 that is attached to the surfaces of the diamond crystals and/or disposed within the plurality of interstitial regions that exist between the bonded together diamond crystals (i.e., the interstitial regions are at least partially filled with catalyst material).

Figure 3B:
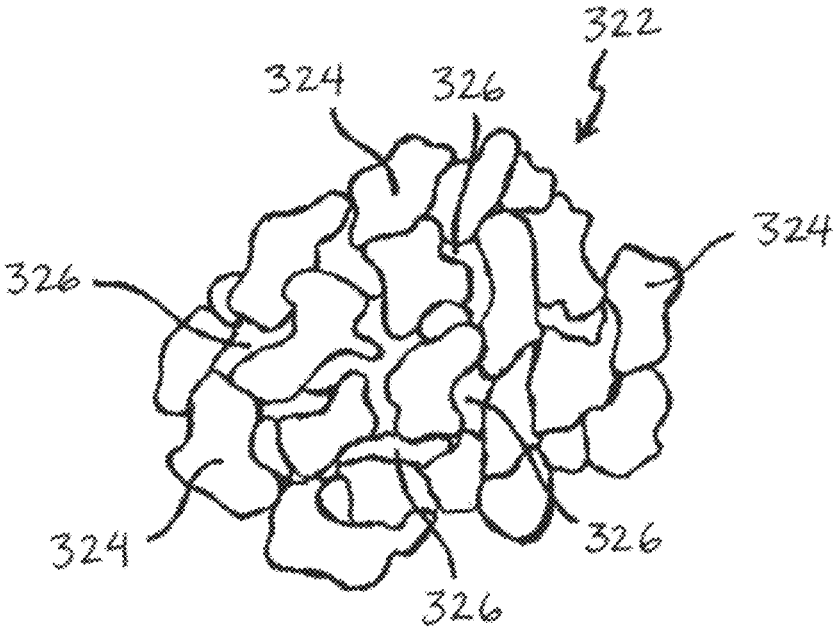
FIG. 3B is a schematic representation of a region of a PCD body that is substantially free of a catalyst material, according to an embodiment of the present disclosure.

FIG. 3B schematically illustrates a region 322 of a PCD body that is substantially free of the catalyst material. Like the PCD region 310 illustrated in FIG. 3A, the region 322 includes a material microstructure comprising a plurality of bonded together diamond crystals 324, forming the intercrystalline diamond matrix first phase. Unlike the region 310 illustrated in FIG. 3A, this region 322 of the PCD body has been treated to remove the catalyst material from the plurality of interstitial regions and, thus, comprises a plurality of interstitial regions 326 that are substantially free of the catalyst material, i.e., substantially empty voids (pores). At least a portion of the pores may be interconnected.

The term "filled", as used herein to refer to the presence of the catalyst material contained in the interstitial regions of the PCD body, is understood to mean that substantially all of the volume of the interstitial regions (voids/pores) contain the catalyst material (and tungsten carbide, and/or trace amounts of other elements such as refractory materials, including Nb, Ta, and Mo that may infiltrate into the PCD; these materials typically react with carbon to form carbides). Also, tungsten carbide and/or trace amounts of Fe or Cr may be present as a byproduct of diamond powder processing. However it is to be understood that there may also be a volume of interstitial regions within the same region of the PCD body that do not contain the catalyst material, and that the extent to which the catalyst material effectively fills the voids or pores will depend on such factors as the particular microstructure of the PCD body, the effectiveness of the process used for introducing the catalyst material, removal of absorbed gases from the surfaces of the diamond powders, and the desired mechanical and/or thermal properties of the resulting PCD body.

According to one embodiment, a PCD body with high diamond frame strength achieves a desired high level of wear resistance. Previous attempts have been made to achieve a cutting element with a PCD body that has both high strength and high wear resistance. However, as mentioned above, these two properties tend to be inversely related, with wear resistance being provided by higher diamond content, and strength being provided by higher catalyst content. Additionally, the strength of a PCD body (including both the diamond and catalyst phases) at room temperature does not necessarily correlate with good wear resistance and performance in the field, where the PCD body is subjected to much higher drilling temperatures.

Accordingly, an investigation was made into the correlation between strength and wear resistance, in order to provide a PCD body that accomplishes both desired properties.

Figure 4:
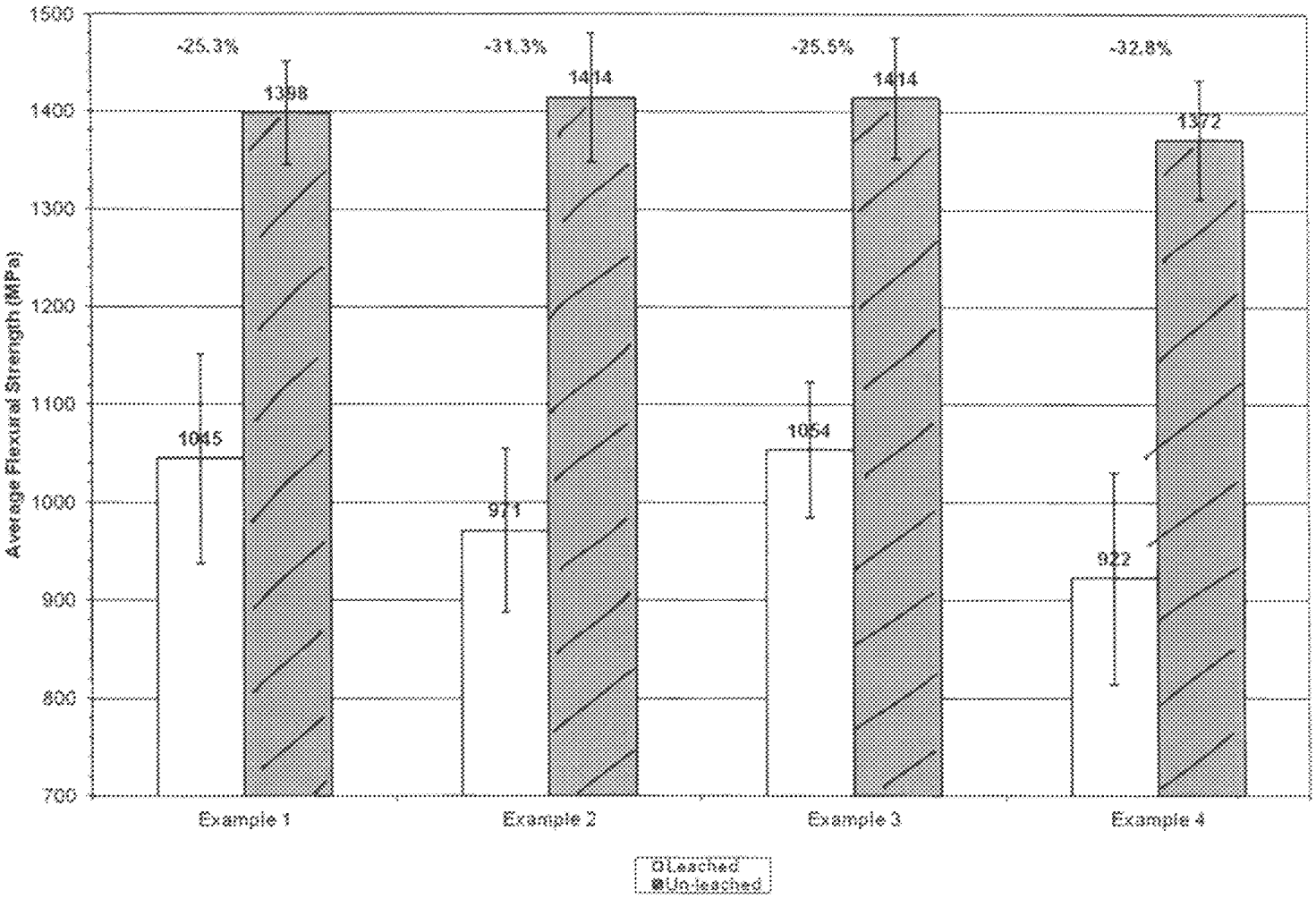
FIG. 4 is a diagram of PCD strength for leached and unleached PCD bodies.

Several PCD bodies were tested as shown in FIG. 4 to identify the strength of the PCD body with and without the catalyst phase. FIG. 4 shows a chart of the average flexural strength of four different PCD bodies, identified as Examples 1-4. As used herein the flexural strength refers to the material resistance against fracture caused by bending stress. Each PCD body was divided into two parts, and one part was subsequently leached to remove the catalyst material from the PCD body. The average flexural strength of each PCD body was measured by a 3-point bending test. In the 3-point bending test, the PCD disks, 16 mm in diameter and 1.3 mm in thickness, were cut by laser beam or by EDM method into bars with dimensions of 2 mm×1.3 mm×8.3 mm. The flexural strength of each bar was measured by the 3-point bending test on a bench-top universal testing machine at room temperature. The universal testing machine was made by Interactive Instruments (704 Corporate Park, Scotia, N.Y. 12302), model number K1-16. The load cell capacity is 1000 lb. The loading rate employed in the bending test was 0.005 mm/minute. The resulting data was plotted in FIG. 4. The leached PCD bodies are plotted on the left side of each pair, and the unleached PCD bodies on the right. At least 21 specimens were tested for each column in FIG. 4, and each column provides the average across the tested specimens.

As shown in FIG. 4, the leached PCD body in each Example exhibited a significant drop in strength as compared to its unleached counterpart. The PCD body identified as Example 1 was found to have a strength of 1398 MPa prior to leaching, and 1045 MPa after leaching. Examples 2, 3, and 4 had strengths of 1414 MPa, 1414 MPa, and 1372 MPa prior to leaching, respectively, and had strengths of 971 MPa, 1054 MPa, and 922 MPa after leaching, respectively. These numbers correspond to a drop in strength of about 25%, 31%, 25%, and 33% for Examples 1-4, respectively. Accordingly, in one embodiment, a PCD body exhibits a drop in compressive stress of up to 25%, and in another embodiment up to 33%, after leaching.

The strength of the unleached PCD bodies includes the strength contributed by both the diamond frame and the secondary catalyst phase. The strength of the leached PCD bodies is the diamond frame strength. This value measures the strength of the sintered, bonded-together diamond grains that form the PCD structure, without any contribution of the secondary catalyst phase. The diamond frame is the microstructure of bonded diamond grains themselves. The spaces within the diamond frame may be infiltrated with catalyst material, as represented in FIG. 3A, or may be empty, as represented in FIG. 3B.

The values in FIG. 4 identify a drop in strength from the unleached PCD body (diamond frame and catalyst material) to the leached PCD (the diamond frame). In order to confirm whether this difference in strength was attributable to the removal of the secondary catalyst phase, a compression test was also performed on these same four Examples. The compressive stress of the PCD bodies was measured by Raman spectroscopy. Additional details regarding Raman spectroscopy can be found in U.S. Pat. No. 7,543,662. The difference in compressive stress between the leached and unleached PCD bodies for each Example was then identified. For Example 1, the leached PCD body exhibited a compressive stress that was 368 MPa less than its unleached counterpart. For Example 2, the difference was 430 MPa, for Example 3 it was 389 MPa, and for Example 4 it was 441 MPa. In each case the leached PCD body exhibited less compression than the unleached PCD body.

These differences in compression correspond in value to the drop in strength identified in FIG. 4. In Example 1, the drop in strength from the unleached to the leached PCD body is 353 MPa, in Example 2 it is 443 MPa, in Example 3 it is 360 MPa, and in Example 4 it is 450 MPa. The drop in compression correlated closely to the drop in strength. This indicates that the strength drop can be attributed to the removal of the compressive stress induced by the catalyst phase.

Thus, at room temperature, the presence of the catalyst phase contributes to the measured strength of the PCD body. However, as noted above, the wear resistance of PCD bodies with high measured strength at room temperature has been less than satisfactory in the field.

Figure 5:
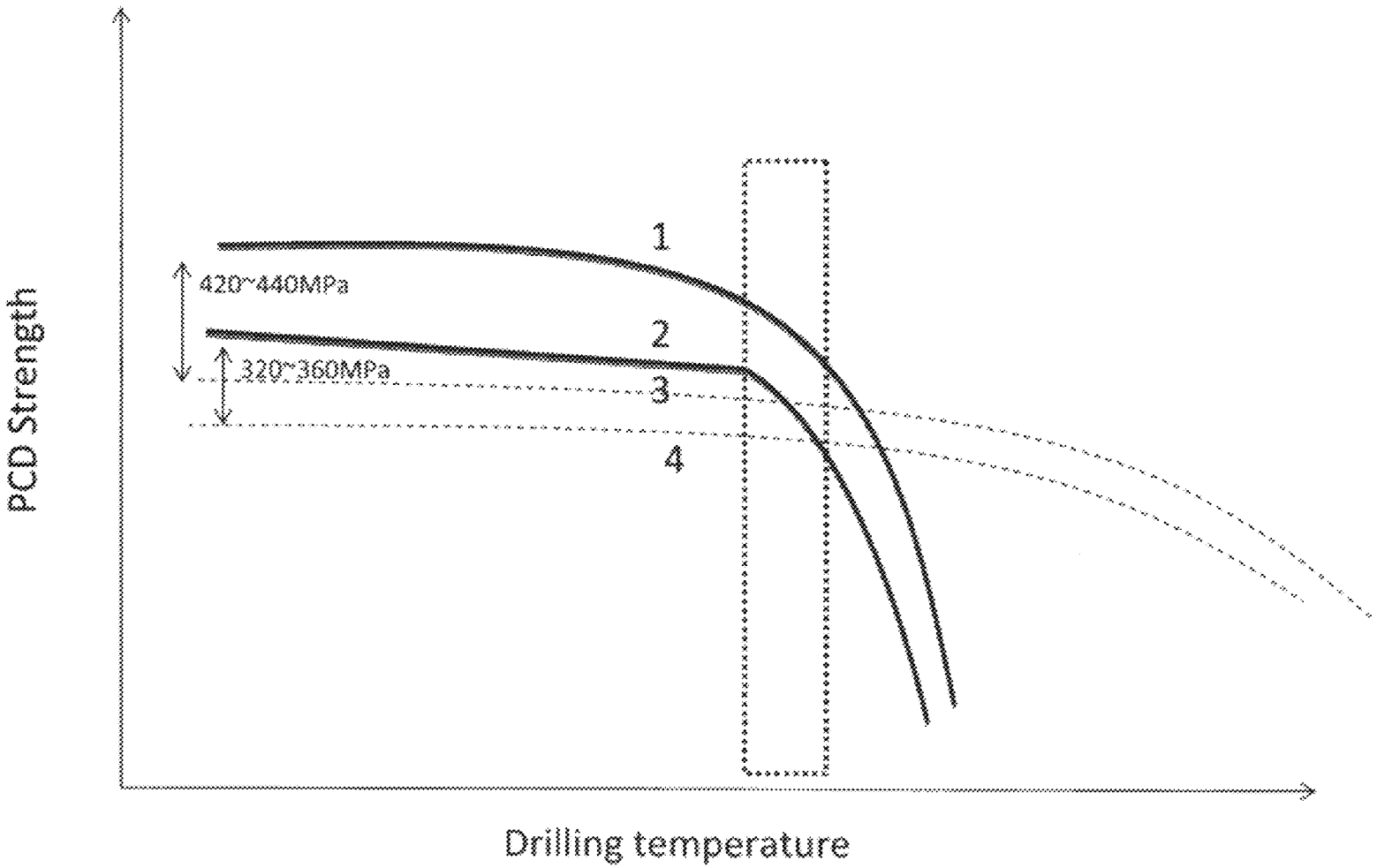
FIG. 5 is a diagram of PCD strength versus drilling temperature for four PCD bodies.

Based on the present investigation, a correlation was found between the presence of the catalyst phase and a drop in strength at high temperature. This relationship is shown in FIG. 5. FIG. 5 shows a plot of PCD strength versus drilling temperature, for four different PCD bodies. Lines 1 and 3 are a PCD body sintered at a first higher pressure, with line 1 representing the unleached PCD body and line 3 the same PCD body after leaching. Lines 2 and 4 are a PCD body sintered at a second lower pressure, with line 2 representing the unleached PCD body and line 4 the same PCD body after leaching. To obtain the data for FIG. 5, the PCD flexural strength data was collected at various temperatures. An individual bend bar was first heated to the target temperature in a tube furnace attached to the testing machine. The mechanical load was then applied at the set temperature. The maximum load each bar could support was recorded to calculate its flexural strength.

At room temperature, the unleached PCD bodies (lines 1 and 2) exhibit a higher strength than the leached PCD bodies (lines 3 and 4), confirming the testing shown in FIG. 4. However, as the temperature increases, such as during a drilling operation in the field, the unleached PCD bodies decline in strength more rapidly than the leached PCD bodies, until the lines actually intersect and the leached PCD bodies exhibit a greater strength. This transition area where the lines intersect is highlighted by the dotted rectangle. Depending on the particular PCD bodies, this transition may take place around about 700-800° C. Drilling temperature continues to increase past this transition region, with some temperatures in the field during drilling operations reaching about 1,000 to 1,200° C.

The strength curves shown in FIG. 5 indicate that at high operating temperatures, the leached PCD bodies exhibit better strength than the unleached PCD bodies. This result is not indicated by testing at room temperature, which tends to show a better strength for the unleached PCD bodies that include a catalyst phase. This room temperature testing is consistent with the understanding that strength and wear resistance require a balance between the relative content of catalyst material and diamond. However, the behavior of these PCD bodies at high temperature, as shown in FIG. 5, indicates that both strength and wear resistance can be achieved at high temperature with leached PCD bodies with particular characteristics.

Furthermore, the strength and compression testing summarized above with respect to FIG. 4 indicates that the difference in strength is attributable entirely to the removal of the catalyst phase. Thus, the wear resistance at high temperature can be correlated with diamond frame strength (the strength of the leached PCD bodies) (see FIG. 5). This testing indicates that PCD bodies with high diamond frame strength perform better at high temperatures than other PCD bodies due to the transition of the catalyst phase material with rising temperatures. At room temperature, the catalyst material occupying the interstitial regions between the bonded diamond grains exerts a compressive force against the diamond grains. This compressive stress was measured as discussed above for the PCD bodies in FIG. 4. If the catalyst material is removed from the PCD body, the compression measured in the PCD body also drops.

As the operating temperature increases (see FIG. 5), the catalyst material and the diamond frame undergo differing thermal expansion. As a result, it is believed that the compression provided by the catalyst material deteriorates, becomes neutral, and ultimately reverts into tension. This tension can cause damage to the diamond frame, introduce thermal stresses, and reduce the strength of the PCD body, as indicated by the downward curve of lines 1 and 2 in FIG. 5. The result may be cracks in the PCD body, fracture, material loss, and failure of the cutting element.

Thus, the performance of a PCD body at high operating temperature can be correlated with the diamond frame strength, rather than the room temperature strength of the diamond and catalyst phase. As used herein, "diamond frame strength" is the flexural strength of the diamond grains themselves, which can be measured by testing the strength of a PCD body with catalyst material removed from the interstitial spaces between the diamond grains (i.e., after leaching). This diamond frame strength can be determined by a 3-point bending test.

Figure 6:
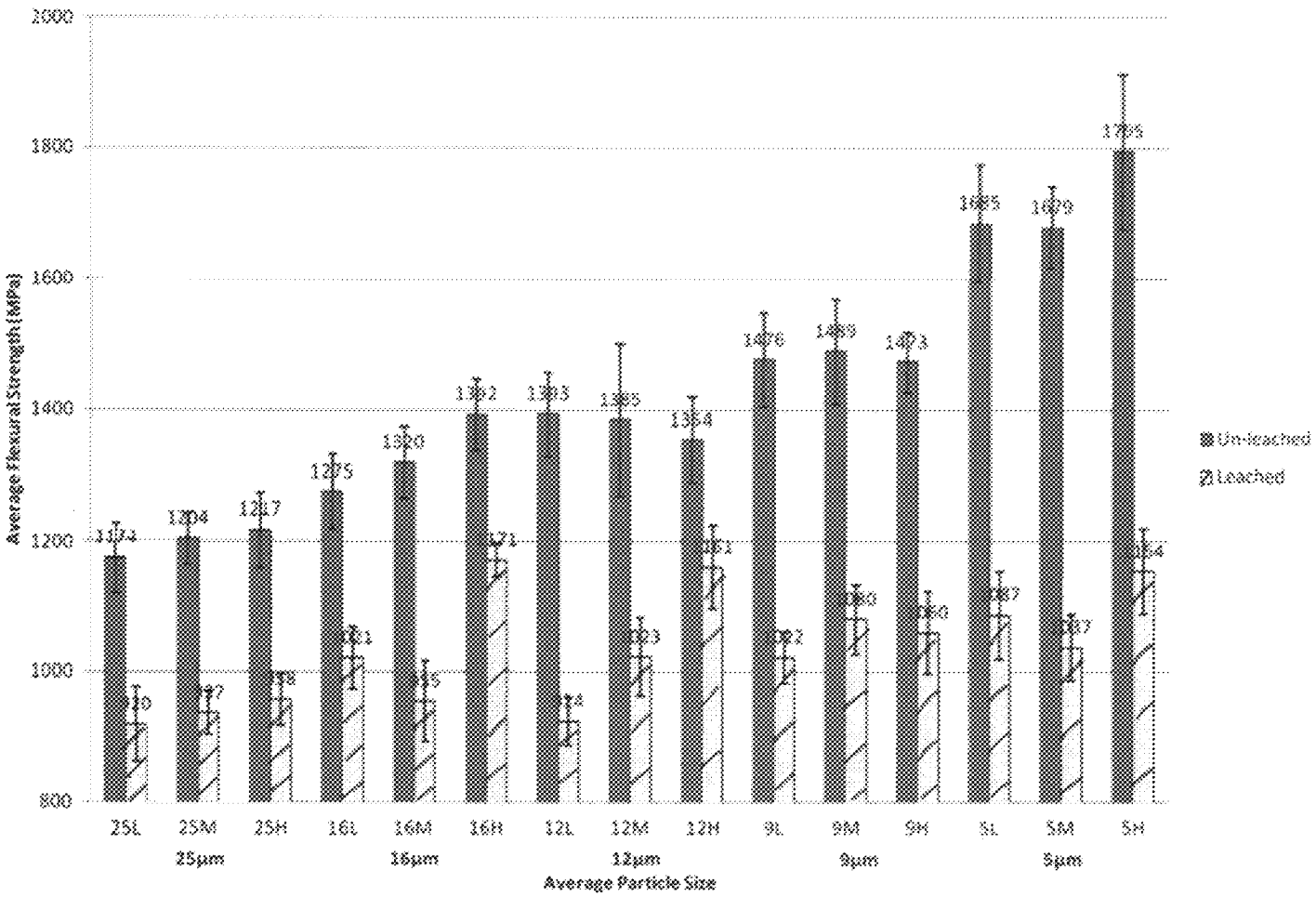
FIG. 6 is a diagram of PCD fracture strength for various PCD bodies with the identified average particle size and sintering pressure.

In order to investigate PCD with high diamond frame strength, several PCD bodies were tested, with the results shown in FIG. 6. FIG. 6 shows the flexural strength of the PCD bodies versus the average particle size of the diamond powder pre-sintering. For each average particle size, three PCD bodies were formed at three different sintering pressures. The three sintering pressure are indicated by the letters L, M, and H, with 25L corresponding to a 25 micron average particle size powder sintered at low pressure, 25M at medium pressure, and 25H at high pressure (low, medium, and high being relative terms only, for this chart). For each particle size, the low pressure was about 5.5-5.6 GPa, the medium pressure was about 6.3-6.5 GPa, and the high pressure was about 6.7 GPa. Finally, each PCD body was divided into two parts, and one part was leached. Thus each PCD body is represented by two bars in FIG. 6, with the bar on the left showing the unleached PCD body, and the bar on the right showing the leached PCD body. At least 21 specimens were tested for each column in FIG. 6, and each column provides the average across the tested specimens.

Although the unleached 5 micron PCD bodies exhibited the highest strength measurements at room temperature, cutting elements with these characteristics have been observed to under-perform in the field. The leached samples (the right-hand bar of each pair) have a lower strength at room temperature than the unleached samples. It was noted that the PCD formed from the smaller particle sizes tended to show a greater drop in strength from the unleached to the leached samples, as compared to the higher particle sizes. This is shown, for example, in the 9 micron and 5 micron PCD bodies in FIG. 6—the difference in strength for these samples is greater than for the other samples. Also, for the leached 9 and 5 micron PCD bodies, the sintering pressure did not clearly correlate with diamond frame strength. The 9L, 9M, and 9H and the 5L, 5M, and 5H samples did not show a clear trend with pressure. These results indicate that other factors in addition to sintering pressure, such as particle size distribution and diamond packing, contribute to the diamond frame strength.

In one embodiment, PCD bodies were prepared and subjected to flexural strength and wear resistance tests to compare the wear resistance of each. Two different diamond particle sizes were used, forming first and second PCD bodies, referred to as PCD A and PCD B below. PCD A was formed with diamond particles having an average particle size of 12 μm. PCD B was formed with diamond particles having an average particle size of 9 μm. Four bodies for PCD A were formed, and two were leached. Four bodies for PCD B were formed, and two were leached. All PCD bodies were HPHT sintered under a pressure of about 67 kbar at a temperature between 1400 and 1500° C.

Figure 7:
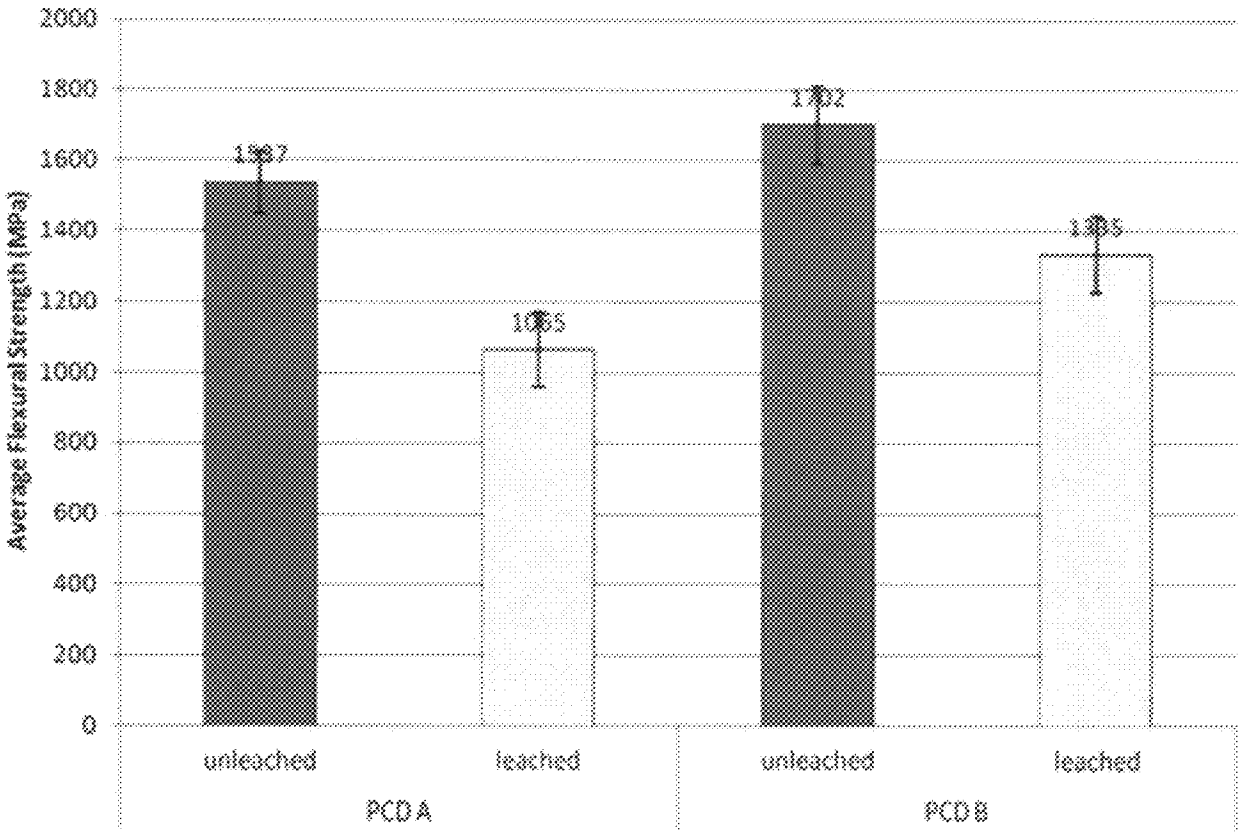
FIG. 7 is a diagram of PCD diamond frame strength for two PCD bodies, each tested in leached and un-leached states.

The flexural strength of the leached and unleached PCD A and PCD B bodies was measured by a three-point bending test, and the results are shown in FIG. 7. PCD A exhibited an average flexural strength of 1537 MPa unleached, and 1065 MPa leached, and PCD B exhibited an average flexural strength of 1702 MPa unleached, and 1335 MPa leached. For the leached bodies, the flexural strength represents the diamond frame strength.

FIG. 7 shows that PCD B exhibited a higher flexural strength than PCD A. The average flexural strength of the PCD B bodies was about 10% higher than PCD A for the unleached bodies, and about 25% higher than PCD A for the leached bodies. Thus the smaller particle size appeared to contribute to a higher flexural strength, with a greater effect on the leached bodies than the unleached bodies. In one embodiment, a PCD body is formed from a diamond particle mixture having an average particle size of 9 μm or less.

Additionally, FIG. 7 shows that the unleached bodies exhibited higher flexural strength than the leached bodies, as expected. The drop in strength from unleached to leached was about 30% for PCD A and 21% for PCD B. Thus, PCD B exhibited a smaller relative drop in strength due to leaching, as compared to PCD A.

Figure 8:
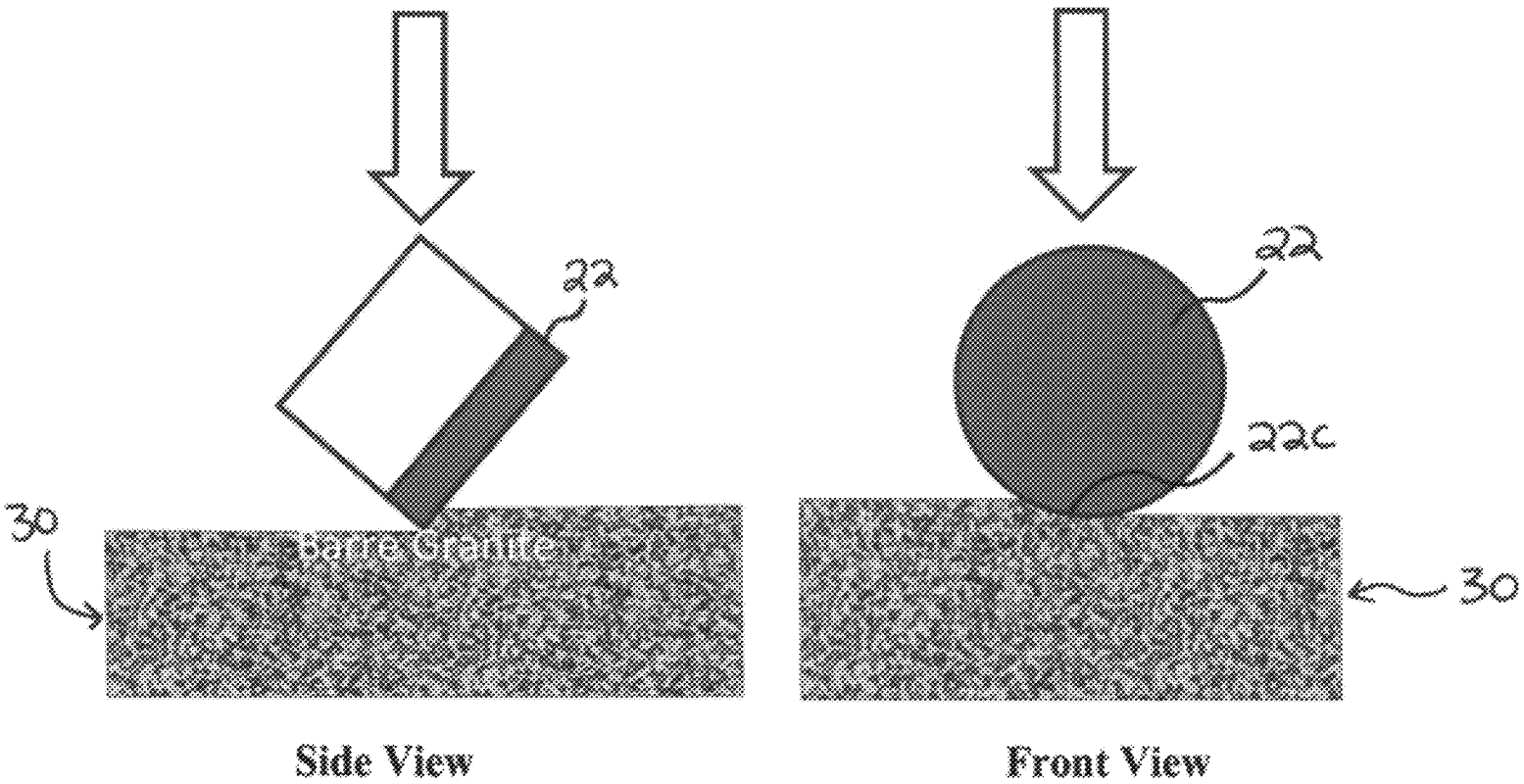
FIG. 8 is a front and side view, respectively, of a cutting element undergoing a vertical lathe test, according to an embodiment.

The PCD A and PCD B samples were also subjected to a wear resistance test. The wear resistance test was a vertical turret lathe (VTL) test, which is shown schematically in FIG. 8. FIG. 8 shows front and side views of the VTL test. The test was conducted by applying a load to the PCD body 22, which is positioned with the cutting edge 22*c* in contact with a rock table 30. The rock table 30 is rotated about a vertical axis. The PCD body is advanced into the rock table, cutting into the rock structure, at a feed rate of 0.1 inches per revolution of the table. In this particular set of testing, the vertical turret lathe machine used was an Essex Machine Tool Services S.O. 1224 56" Bullard Dynatrol VTL with GE/Fanuc 18i-TA CNC controls. The rock table 30 was made of barre granite and had a diameter of 36 inches. The load applied to the cutter ranged from 200 to 2,000 pounds to move the cutter at the specified feed rate. As the test progressed, the PCD body cut through the rock table, causing wear on the PCD body. The wear-flat area on the PCD body was measured after each set of 5 passes (one pass being equal to advancement of the PCD body by 0.02 inches into the rock table).

The VTL wear resistance test was conducted on six of the PCD bodies—the two unleached PCD A bodies, two leached PCD A bodies, and two leached PCD B bodies. The unleached PCD B bodies were not tested, due to the limited size of the rock table. The six samples tested were all tested on the same rock table 30.

Figure 9:
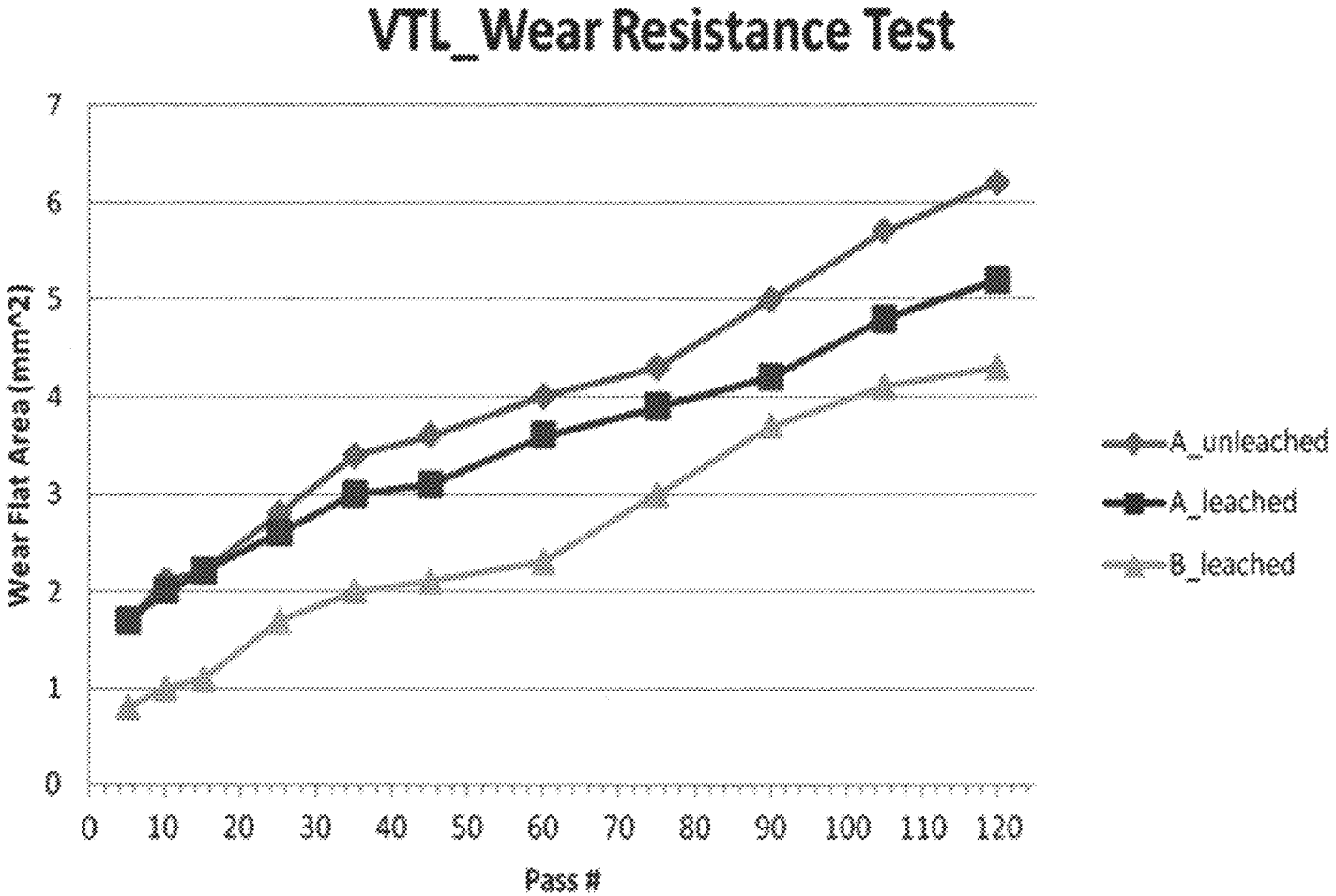
FIG. 9 is a diagram of the results of the wear resistance test of FIG. 8, performed on various PCD bodies according to an embodiment.
Figure 10:
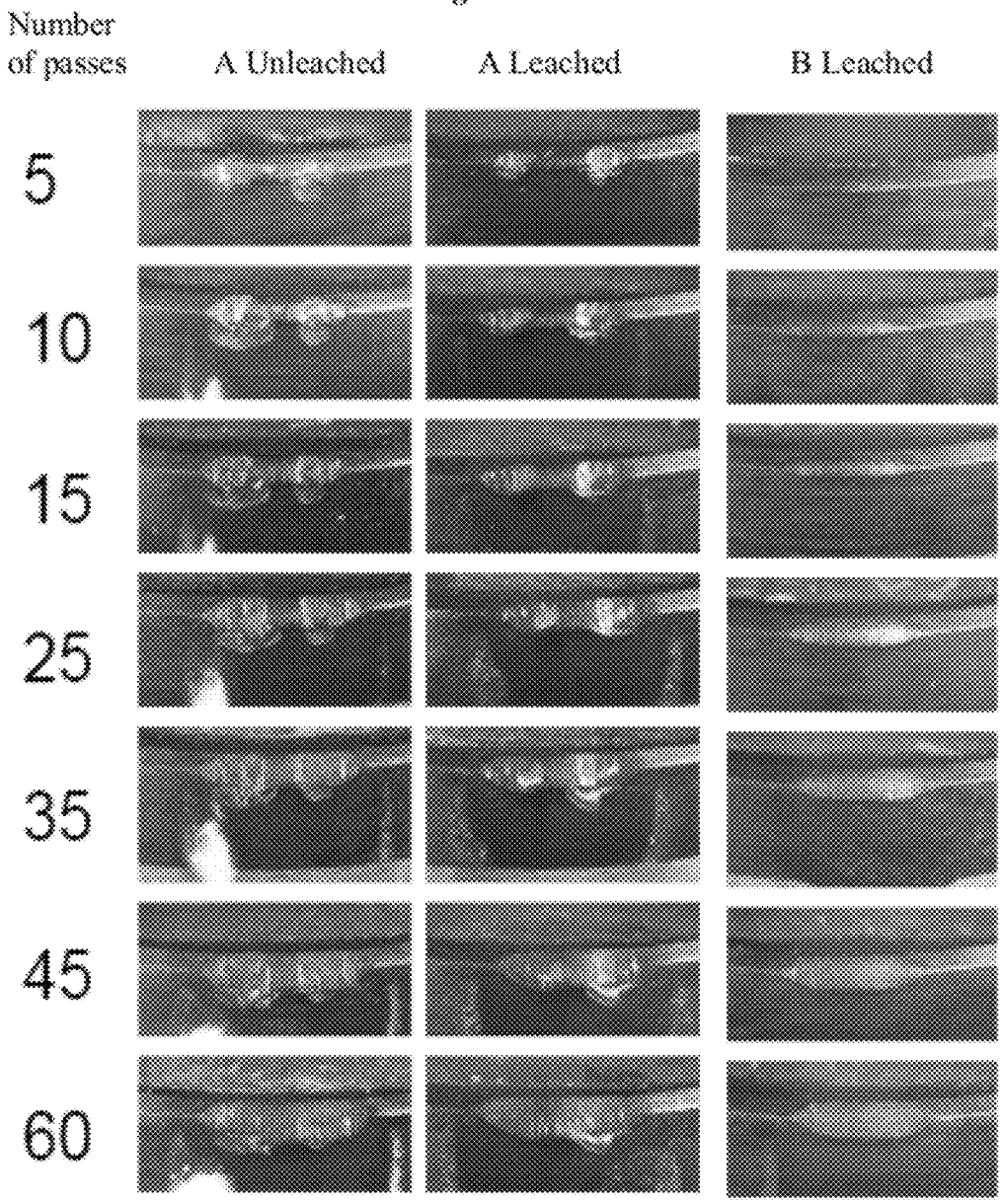
FIG. 10 is a collection of images of the results of the wear resistance test of FIG. 9, performed on three PCD bodies.

The results of this testing are shown in FIGS. 9 and 10. FIG. 9 shows the wear-flat area of the PCD bodies versus the number of passes of the VTL test. A higher wear-flat area indicates a lower wear resistance. As shown in FIG. 9, the leached PCD B sample exhibited the highest wear resistance, followed by the leached PCD A sample. The unleached PCD A sample exhibited the lowest wear resistance, and the largest wear-flat area. Thus, comparing FIGS. 7 and 9, although the unleached samples showed higher strength at room temperature, the unleached PCD A sample exhibited the lowest wear resistance. The leached samples, which showed a lower strength at room temperature, showed less wear resistance during the VTL test than the unleached PCD A bodies. Additionally, the smaller particle size utilized in PCD B appeared to contribute to an increased wear resistance, as compared to PCD A (FIG. 9).

Photographs of one unleached PCD A body, one leached PCD A body, and one leached PCD B body were taken during the VTL testing, and these photographs are shown in FIG. 10. These photographs show that the leached PCD B body showed less wear than the other two, and the unleached PCD A body showed the most wear. This testing shows that unleached PCD had poorer wear resistance, despite higher room-temperature strength. In the leached condition, the diamond frame strength correlated with an increase in wear resistance (see leached PCD B bodies). The wear flat observations also suggested the PCD bodies with lower strength exhibited secondary wear behavior (in addition to pure wear), which was fracturing or flaking along the wear flat bottom line.

Additional testing was conducted to investigate correlations between flexural strength and average starting particle size, as well as sintering pressure. Two different starting particle sizes were used to create PCD bodies, referred to as PCD C and PCD D below. PCD C was formed with diamond particles having an average starting particle size of 9 μm. These particles were HPHT sintered at two different sintering pressures to form PCD bodies. PCD D was formed with diamond particles having an average starting particle size of 16 μm. These particles were also HPHT sintered at two different sintering pressures. At least 21 samples of each PCD body at each condition were tested to collect the flexural strength data below.

For each type of PCD body, half of the samples were leached, and the rest remained unleached. The samples were then subjected to a 3-point bending test to determine the flexural strength. The average flexural strength for each type of PCD body is provided in Table 1 below.

TABLE 1

| PCD | Average Starting Particle Size (μm) | Sintering Pressure (kbar) | Average Flexural Strength (MPa) Unleached | Average Flexural Strength (MPa) Leached |
|---|---|---|---|---|
| C | 9 | 67 | 1563 ± 122 | 1106 ± 67 |
| | 9 | 70-72 | 1679 ± 143 | 1166 ± 77 |
| D | 16 | 67 | 1389 ± 65 | 1076 ± 64 |
| | 16 | 70-72 | 1520 ± 108 | 1208 ± 76 |

Table 1 indicates that higher flexural strength is correlated with higher sintering pressure and with smaller starting particle size.

Additional testing was conducted to investigate correlations between flexural strength and particle size distribution (PSD). Two different PSD's were used to create PCD bodies, referred to as PCD E and PCD F. The PSD for each PCD body is shown in Table 2 below. The diamond particles were HPHT sintered at a pressure of about 67 kbar and a temperature between 1400 and 1500° C. to form PCD bodies, and the PCD bodies were subjected to a 3-point bending test to determine the flexural strength (unleached). These results are shown in Table 2.

TABLE 2

| PCD | PSD Recipe | Average Flexural Stregth (MPa)/unleached |
|---|---|---|
| E | (6-12 μm) + 10-20 μm): 88%<br>2-4 μm: 12% | 1456 ± 71 |
| F | (6-12 μm) + (10-20 μm): 84%<br>2-4 μm: 11%<br>0.5-1 μm: 5% | 1249 ± 97 |

Table 2 shows that the PSD affected the resulting flexural strength of the sintered PCD body. In this case, the addition of the smaller particles in PCD F appeared to negatively impact the flexural strength. Accordingly an optimal PSD may be achieved that correlates with an increased diamond frame strength. The average starting particle size, PSD, and sintering pressure all contribute to the resulting diamond frame strength.

Based on the above testing, a PCD body was created from diamond particles with an average starting particle size of 9 μm and a sintering pressure between 70-72 kbar. The resulting PCD body exhibited an unleached flexural strength of 1702±120 MPa, and a leached flexural strength (diamond frame strength) of 1335±110 MPa.

In one embodiment, a PCD body with a diamond frame strength of about 1300 MPa or greater provides a desirable combination of wear resistance and strength. In one embodiment, the PCD body with high diamond frame strength is formed by providing a diamond particle powder mixture having an average particle size of about 7-9 microns and a Weibull distribution. The diamond powder is HPHT sintered adjacent to a carbide substrate in a press at a pressure of about 7.0-7.2 GPa. The resulting PCD body has a sintered diamond grain size of about 5-7 microns and a diamond frame strength of about 1300 MPa or greater, in one embodiment about 1375 MPa. This PCD body exhibited a drop in compression after leaching of about 18-22%. The diamond frame strength can be verified by either leaching the PCD body and measuring its strength (such as by a 3-point bending test), or by dividing the PCD body into two parts, leaching one part, and measuring the strength of the leached part. The unleached part may also be tested for strength, although its measured strength at room temperature should be higher due to the presence of the secondary catalyst phase. In one embodiment, the leached part shows a diamond frame strength of at least 1300 MPa, and the unleached part shows a combined diamond and catalyst strength of at least 1500 MPa. The PCD body can be finished into the desired geometry and incorporated into a cutting element for use in the field.

In another embodiment, the diamond powder mixture includes 80% diamond particles having an average particle size in the range of 15-20 microns, and 20% diamond particles having an average particle size in the range of 2-4 microns. In another embodiment, the diamond powder mixture includes 80% diamond particles having an average particle size in the range of 16-17 microns, and 20% diamond particles having an average particle size in the range of 2-3 microns. The diamond powder mixture is sintered at a pressure of about 7.0 GPa, forming a PCD body with a diamond frame strength of 1200 MPa or greater (or 1300 MPa or greater), a diamond volume fraction of 93% or greater, and an average sintered grain size between about 9-14 microns.

In one embodiment, a PCD body sintered at about 7.0 GPa or greater comprises a diamond frame strength of about 1200 MPa or greater, such as about 1300 MPa or greater, and the PCD body exhibits a drop in compressive stress of about 15 to 25% after leaching, at room temperature, such as about 18-22%. In one embodiment the PCD body exhibits a drop in compressive stress of up to 25%.

In one embodiment, a cutting element such as cutting element 20 in FIG. 2 includes a polycrystalline diamond body 22, which has an interface surface, a top surface opposite the interface surface, a cutting edge meeting the top surface, and a material microstructure. The material microstructure includes bonded-together diamond crystals and interstitial regions between the diamond crystals. The microstructure has a first region that includes at least a portion of the cutting edge. The first region has a diamond frame strength of about 1300 MPa or greater. The first region may extend throughout the entire PCD body, or through only a portion of the PCD body. In one embodiment, the first region extends through a portion of the PCD body that includes at least a portion of the cutting edge.

According to an embodiment, the sintered PCD body with high diamond frame strength has a sintered average diamond grain size of less than 14 microns, and in another embodiment less than 10 microns, in another embodiment less than 7 microns, in another embodiment about 6-7 microns, in another embodiment about 5-6 microns, in another embodiment less than 5 microns, and in another embodiment about 2-4 microns.

As described herein, the temperatures used during the HPHT sintering process may be in the range of from 1350° C. to 1500° C., for example 1400° C. to 1500° C., or for example from 1400° C. to 1450° C. Temperatures typically are kept around 1450° C. or below, and are not raised much beyond 1500° C., due to the resulting reactions in the surrounding cell materials (niobium/tantalum reactions and salt-NaCl melt). HPHT sintering to create PCD with high diamond frame strength may be performed at a slightly higher temperature than other HPHT sintering processes.

The mixture of diamond grains (natural or synthetic) and catalyst material may be subjected to sufficient HPHT conditions for a period of time to sinter the diamond crystals forming the PCD body, as described herein, and optionally, to bond the PCD body to a substrate. Suitable internal cold cell pressures required to obtain a desired diamond frame strength depend on several factors such as the amount and type of catalyst present as well as the particle size and distribution of the diamond crystals used to form the PCD body, the diamond powder packing, and the addition of graphite. In the various examples described herein, no graphite was added to the powder mixtures. The diamond powders were subjected to a 1280° C. vacuum environment for 1-2 hours before sintering. No graphite was detectable by subsequent examination of the powder by Raman spectroscopy, which is well known in the art as a standard carbon phase characterization technique.

According to an embodiment, the pressure applied during HPHT sintering to achieve a PCD body with high diamond frame strength is about or above 7.0 GPa, or in the range of about 7.0 to 8.2 GPa, or 7.0 to 7.2 GPa, or 7.0 to 7.5 GPa, or 7.5 to 8.0 GPa, or greater than 8.0 GPa. The pressure applied may vary with the diamond particle size. For example, in one embodiment, a diamond powder mixture with an average particle size within the range of 10-25 microns is sintered at a pressure of about 7.5 GPa. In another embodiment, a diamond powder mixture with an average particle size of about 5-10 microns is sintered at a pressure of about 7.5-7.8 GPa. In another embodiment, a diamond powder mixture with an average particle size of about 2-4 microns is sintered at a pressure of 8.0 GPa or above, such as 8.0 GPa to 8.2 GPa.

In one embodiment, a method of forming a PCD body with high diamond frame strength is provided. The method includes sintering the diamond powder mixture at a pressure of at least 7.0 GPa or greater. The diamond mixture includes a well-packed mixture of fine diamond particles. The close packing of these fine particles and the high sintering pressure creates a sintered microstructure with high diamond content and strong diamond-to-diamond bonding. These steps reduce the content of catalyst material in the sintered PCD body, and thereby reduce the compression provided by the secondary phase at room temperature. Reduction of the catalyst phase content and the magnitude of compression from the catalyst phase in turn reduces the dependence on cobalt compressive stress to produce high strength, and thus is beneficial for creating a fine-grain sintered PCD with high diamond frame strength.

After sintering, the method may optionally include leaching all or a portion of the PCD body. When leaching is desired, complete leaching can be achieved in the PCD sample by placing the sample in an acid solution in a Teflon container, which is contained within a sealed stainless steel pressure vessel and heated to 160-180° C. Containers suitable for such leaching procedures are commercially available from Bergoff Products & Instruments GmbH, Eningen, Germany. It is likely that pressures of between 100-200 psi are achieved by heating under these conditions. A standard acid solution which has been found to work satisfactorily in leaching PCD material is made from reagent grade acids and comprises a concentration of approximately 5.3 mol/liter $HNO_3$ and approximately 9.6 mol/liter HF, which is made by ratio of 1:1:1 by volume of $HNO_3$—15.9 mol/liter (reagent grade nitric acid):HF—28.9 mol/liter (reagent grade hydrofluoric acid):and water. Verification of the leaching process is performed by examining the leached PCD sample with penetrating x-ray radiography to confirm that the acid mixture penetrated the sample and that no macro-scale catalytic metallic regions remain. Alternatively, the PCD on a cutter containing a substrate can be leached using means to protect the substrate from exposure to the acid and/or acid fumes.

In one embodiment, a method of forming a PCD body with high diamond frame strength includes tightly packing the diamond powder pre-sintering. This is particularly useful for diamond particle mixtures with a fine particle size, which otherwise may result in a PCD structure with a large porosity. For a given sintering pressure, increasing the average particle size leads to a decrease in porosity in the sintered PCD body. This result is likely due the fracturing of the larger diamond crystals during the HPHT sintering. Finer diamond crystals are more resistant to fracturing than the larger diamond crystals, which fracture and rearrange themselves under pressure, compacting and packing more effectively into the spaces between the crystals. Very small diamond particles tend to be more difficult to compact and fracture during sintering.

Thus, a PCD structure with very fine diamond grains may include a larger relative porosity, with a weaker diamond frame and a lower diamond frame strength. This fine grade, unleached PCD will exhibit a high strength, due to the presence of the catalyst material in the pores between the fine diamond grains. Room temperature testing of the unleached fine PCD body shows promising results, but the degradation of the catalyst phase into tension at high operating temperatures can cause failure of the cutting element, as explained above.

Thus, in one embodiment, in order to obtain a PCD body with high diamond frame strength and a fine diamond grain structure, the fine diamond particles are tightly packed prior to sintering, and then HPHT sintering is performed under very high pressure, such as pressures of at least 7.0 GPa. In another embodiment the pressure is in the range of 7.0-8.2 GPa, and in another embodiment 7.0-7.2 GPa, and in another embodiment 7.0-7.5 GPa, and in another embodiment 7.5-8.0 GPa, and in another embodiment greater than 8.0 GPa. Prior to sintering, the diamond particles may be pre-compacted, such as by applying a pressure in the range of 100-200 MPa, or even up to 600 MPa, to tightly pack the diamond powder.

The pre-sintered diamond powder may have a mono-modal or multi-modal particle size distribution. If a catalyst material is mixed with the diamond crystals, the catalyst material may be provided in the form of a separate powder or as a coating on the diamond particles.

In one embodiment, a PCD body with high diamond frame strength is incorporated into a shear cutter with a cutting edge, such as the cutting element 20 with cutting edge 22*c* shown in FIG. 2. The PCD body includes a region that incorporate at least a portion of the cutting edge. This region of the PCD body has a high diamond frame strength, such as at least 1300 MPa.

Due to thermal expansion of the diamond and catalyst phases in the PCD body, the strength of the PCD body at room temperature does not necessarily correlate with wear resistance at elevated temperatures. According to embodiments of the present disclosure, high pressure sintering and other techniques are used to provide a PCD body with a high diamond frame strength, which shows improved wear resistance at elevated temperatures. A shear cutter is provided that incorporates this PCD material along at least a portion of the shear cutter cutting edge, for improved wear resistance.

In one embodiment, a PCD body with high diamond frame strength also exhibits a high diamond content, or high diamond volume fraction. PCD with high diamond content is described in more detail in co-pending U.S. application Ser. No. 12/784,460, filed May 20, 2010, published as U.S. Publication No. 2010/0294571, the contents of which are hereby incorporated by reference. In one embodiment, PCD with high diamond content may be formed through HPHT sintering at higher than normal pressures, such as about 6.2 GPa to 7.1 GPa. In one embodiment, PCD with both high diamond frame strength and high diamond content is formed through HPHT sintering at even higher pressures, in the range of 7.2 GPa to 8.2 GPa, or above 8.2 GPa. These pressures are the pressure at the increased sintering temperature (i.e., not the cold cell pressure).

In various embodiments, a PCD body may have a first region proximate the top surface, and a second region proximate the interface with the substrate. At least the first region includes PCD having a high diamond frame strength. In one embodiment, the first region has diamond volume fraction of greater than 90% by volume (% v), for example at least 91% v, at least 92% v, at least 92.5% v, at least 93% v, or at least 94% v in other embodiments. In one or more embodiments, the cutting element has a first region having a diamond volume fraction in the range of from greater than 90% v to 99% v, such as 93.5% v, 94.5% v, 95% v, 96% v, 97% v, or 98% v. In one embodiment, a first region of a PCD body includes a sintered average grain size less than 25 microns and a diamond volume fraction greater than 92%; and in another embodiment a sintered average grain size of at most 15 microns and a diamond volume fraction greater than 92.5%; and in another embodiment a sintered average grain size in the range of from 2.5 to 12 microns and a diamond volume fraction greater than 93%.

In one or more embodiments, a major portion (i.e., greater than 50% by volume) of the second region of the PCD body may have a lower diamond content (e.g. lower diamond volume fraction) than the first region. In one or more embodiments, a major portion of the second region of the PCD body may have a diamond volume fraction more than 2% lower than the diamond volume fraction of the first region (e.g., proximate the exterior surface of the PCD body), for example at least 3% v or at least 4% v lower than the first region. In this embodiment, the diamond volume fraction of the second region may be at least 85%, for example in the range of from 85% to 95%, for example 87.5%, 90%, or 92%. The diamond content may change in a gradient or step-wise manner within the PCD body.

In one embodiment, a PCD body with high diamond frame strength may include first and second regions within the PCD body, with different material characteristics. For example, the PCD body may be leached to a certain depth to create a first leached region and a second unleached region. The PCD body may be leached to any depth. In one embodiment, the first leached region may extend at least 300 microns within the diamond body, from the cutting edge. Examples of suitable leach depths include 325 microns, 375 microns, 425 microns, 450 microns, 475 microns, 500 microns, 550 microns, 600 microns, 650 microns, 700 microns, 750 microns, 800 microns, 900 microns, or 1000 microns, or within a range of 300-600 or 300-1000 microns. Alternatively, the first leached region may extend to a leach depth of at most 300 microns, such as 40 microns, 50 microns, 100 microns, 150 microns, 200 microns, 250 microns, or within a range of 40-200, or 40-300 microns. The second region within the PCD body containing catalyst material may have a thickness that is sufficient to maintain a desired bond strength between the PCD body and the material to which it may be attached (e.g., the substrate). In one embodiment, a cutting element with a cutting edge formed from PCD that has substantially empty interstitial regions and a high diamond frame strength provides superior performance.

In one embodiment, the first region of the PCD body having a depth of at least 300 microns may extend along at least a "critical zone" when viewed in vertical cross-section. The critical zone extends along the length of the cutting edge and along the upper surface of the PCD body for at least 1000 microns, for example at least 12.5% of the diameter of the cutting element, measured from the side surface, and at least 300 microns along the side surface, measured along the side surface from the lower end of the cutting edge. The critical zone also extends along at least a portion of the circumferential distance of the PCD body. Suitably, the critical zone may extend along a major portion of the circumferential distance of the PCD body, such as along 25% of the circumference. Suitably, the critical zone may extend along the entire circumferential distance of the PCD body allowing the cutting element to be reused on a drill bit without having to undergo an additional treatment step.

In another embodiment, the first region extends along an entire perimeter of the cutting element, and in another embodiment it extends along the entire top surface, the cutting edge, and at least a portion of a side surface. In another embodiment, the first region extends throughout the polycrystalline diamond body.

In another embodiment, a PCD body with high diamond frame strength may have a bilayer construction, including a first layer proximate the cutting edge and a second layer proximate the interface with the substrate. The second layer of PCD material proximate the interface (the PCD "bilayer" or the "interlayer") has more catalyst material and a lower diamond content than the remainder of the PCD layer. This bilayer construction can be formed using two or more diamond mixtures to form different layers of the PCD body. Other options include powder mixtures having the same average grain size but differing particle size distributions, and/or powder mixtures incorporating differing amounts of premixed solvent catalyst or other particulate additions such as tungsten or tungsten carbide. For example, the diamond particle distribution may be adjusted in the mixture near the interface with the substrate, to provide a desired porosity in the second layer. In another example embodiment, a larger amount of catalyst material may be added to the diamond mixture in the second layer near the substrate interface than in the one or more diamond mixtures used to form the rest of the diamond body (e.g., the first layer). In an example embodiment, the first layer of the diamond body may be formed from one or more diamond mixtures having a different particle size distribution than the one or more diamond mixtures used to form the second layer of the diamond body. In additional embodiments, three or more layers using different diamond mixtures may be used.

The bilayer construction may be treated to remove the catalyst material from a first region of the PCD body, such that the first region has a plurality of substantially empty interstitial regions. A second region may include catalyst material in the interstitial regions. The first region may extend partially through the first layer of the bilayer construction, all the way through the first layer, or all the way through the first layer and partially through the second layer.

Optionally, the PCD diamond body may be bonded to a substrate. In one or more embodiments, the substrate may comprise a metal carbide and a metal binder which has been sintered (also referred to herein as a sintered metal carbide). Suitably, the metal of the metal carbide may be selected from chromium, molybdenum, niobium, tantalum, titanium, tungsten and vanadium and alloys and mixtures thereof. For example, sintered tungsten carbide may be formed by sintering a mixture of stoichiometric tungsten carbide and a metal binder. The substrate may contain metal carbide (e.g., tungsten carbide) in the range of from 75 to 98% by weight, based on the total weight of the substrate, suitably from 80 to 95% by weight, more suitably from 85 to 90% by weight. The amount of metal binder may be in the range of from 5 to 25% weight (% w), based on the total weight of the substrate, in particular from 5 to 15% w, for example 6% w, 8% w, 9% w, 10% w, 11% w, 12% w, 13% w, or 14% w, on the same basis. In one or more embodiments, the amount of metal binder in present in the substrate may be in the range of from 6% w to 9% w, or 9% w to 11% w, based on the total weight of the substrate. A greater amount of metal binder in the substrate may improve fracture toughness of the substrate while a lesser amount of metal binder may improve wear resistance of the substrate, in particular hardness, abrasion resistance, corrosion resistance, and erosion resistance.

In one or more embodiments, diamond powder containing diamond crystals or grains (natural or synthetic) may be placed into an assembly with a source of catalyst material for the HPHT sintering process. The source of catalyst material may be in the form of a powder mixed with the diamond powder or in the form of a coating on the diamond crystals. The amount of catalyst material provided in combination with the diamond crystals (whether in the form of a powder, tape, or other conformable material) may be in an amount of at most 3% w, suitably at most 2% w. Alternatively, or in addition, the source of catalyst material may be in the form of a substrate positioned adjacent the diamond mixture in the assembly.

In another embodiment, a PCD cutting element with high diamond frame strength has a substrate with a reduced coefficient of thermal expansion. This can be accomplished by reducing the cobalt content of the substrate. In one embodiment, the cobalt content of the substrate (prior to sintering) is within the range of approximately 6% to 13% by weight. In another embodiment, the cobalt content of the substrate is less than or equal to about 11% by weight, and in another embodiment within the range of approximately 9% to 11% by weight. This modification brings the coefficients of thermal expansion of the substrate and the PCD layer closer to each other, which reduces the thermal stresses at the interface.

Figure 12:
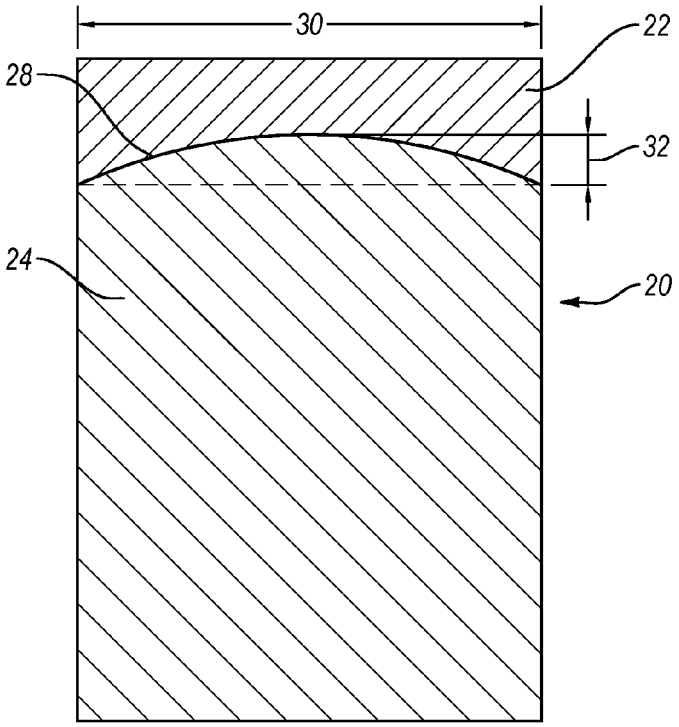
FIG. 12 is a cross-sectional view of an example embodiment cutting element.
Figure 13:
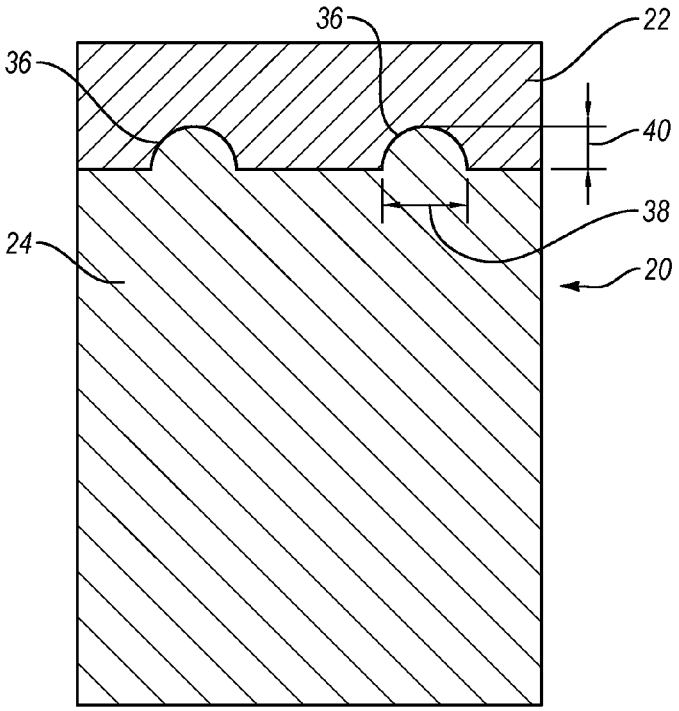
FIG. 13 is a cross-sectional view of another example embodiment cutting element.

In one embodiment, the interface 28 between the PCD layer 22 and the substrate 24 has non-aggressive protrusions 36. The interface may be flat or include a slight dome (with a height 32 to diameter 30 ratio of at most 0.2, or at most 0.1, such as zero to 0.2 or zero to 0.1), and/or one or more non-aggressive protrusions (FIG. 12). In one or more embodiments, the one or more non-aggressive protrusions 36 have continuously contoured surfaces. In one or more embodiments, the interface surface of the substrate has only non-aggressive protrusions 36 thereon, such as protrusions with a protrusion ratio (the height 40 to width 38 ratio of the protrusion) less than 0.7 (FIG. 13). The non-aggressive protrusions are intended to reduce stress concentrations that can lead to cracks in the PCD layer along the interface. In another embodiment, the interface has a smooth surface devoid of protrusions and depressions. In one embodiment, the interface is a flat surface, without a dome, protrusions, or depressions (height to diameter ratio of zero).

The high diamond content PCD bodies disclosed above may be formed as a cutting element, such as a shear cutter, for incorporation into a downhole tool such as a drill bit. Such cutting elements as described herein may be used in any number of applications for example downhole tools such as reamers, bi-center bits, hybrid bits, impregnated bits, roller cone bits, milling bits, as well as other downhole cutting tools.

As used herein, the term "catalyst material" is understood to refer to materials that were used to initially form the diamond layer (i.e., bond the diamond particles together), and can include materials identified in Group VIII of the Periodic table (e.g., cobalt). The catalyst material may be selected from Group VIII elements of the Periodic table (CAS version in the CRC Handbook of Chemistry and Physics), in particular selected from cobalt, nickel, iron, mixtures thereof, and alloys thereof, such as cobalt.

As used herein, the term "removed" is used to refer to the reduced presence of a specific material in the interstitial regions of the diamond layer, for example the reduced presence of the catalyst material used to initially form the diamond body during the sintering or HPHT process, or metal carbide present in the PCD body (a metal carbide, such as tungsten carbide, may be present through addition to the diamond mixture used to form the PCD body (for example from ball milling the diamond powder) or through infiltration from the substrate used to form the PCD body). It is understood to mean that a substantial portion of the specific material (e.g., catalyst material) no longer resides within the interstitial regions of the PCD body, for example the material is removed such that the voids or pores within the PCD body may be substantially empty. However, it is to be understood that some small amounts of the material may still remain in the microstructure of the PCD body within the interstitial regions and/or remain adhered to the surface of the diamond crystals.

By "substantially free of added catalyst material", it is understood to mean that no catalyst material, other than catalyst material left as an impurity from manufacturing the diamond crystals, is added to the diamond mixture. That is, the term "substantially free", as used herein, is understood to mean that a specific material is removed, but that there may still be some small amounts of the specific material remaining within interstitial regions of the PCD body. In an example embodiment, the PCD body may be treated such that more than 98% by weight (% w of the treated region) has had the catalyst material removed from the interstitial regions within the treated region, in particular at least 99% w, more in particular at least 99.5% w may have had the catalyst material removed from the interstitial regions within the treated region. 1-2% w metal may remain, most of which is trapped in regions of diamond regrowth (diamond-to-diamond bonding) and is not necessarily removable by chemical leaching.

The term "substantially empty", as used herein, is understood to mean that at least 75% of the volume of a void or pore is free from a material such as a catalyst material or metal carbide, suitably at least 85% v, more suitably at least 90% v is free from such materials. The quantity of the specific material remaining in interstitial regions after the PCD body has been subjected to treatment to remove the same can and will vary on such factors as the efficiency of the removal process, and the size and density of the diamond matrix material. The specific material to be removed from the PCD body may be removed by any suitable process. Treatment methods include chemical treatment such as by acid leaching or aqua regia bath and/or electrochemical treatment such as by an electrolytic process. Such treatment methods are described in US2008/0230280 A1 and U.S. Pat. No. 4,224,380, which methods are incorporated herein by reference. Treatment by leaching is also discussed in more detail below.

The average grain size of a PCD sample can be determined by an electron back scatter diffraction (EBSD) technique, as follows. A suitable surface preparation is achieved by mounting and surfacing the PCD sample using standard metallographic procedures, and then subsequently producing a mirror surface by contact with a commercially available high speed polishing apparatus (available through Coborn Engineering Company Limited, Romford, Essex, UK). The EBSD data is collected in a scanning electron microscope suitably equipped to determine grain orientation by localized diffraction of a directed electron beam (available through EDAX TSL, Draper, Utah, USA). Magnification is selected such that greater than 1000 grains are included in a single image analysis, which was typically between 500×-1000× for the grain sizes examined. Other conditions may be as follows: voltage=20 kV, spot size=5, working distance=10-15 mm, tilt=70°, scan step=0.5-0.8 microns. Grain size analysis is performed by analysis of the collected data with a misorientation tolerance angle=2°. Defined grain areas determined according to the above conditions are sized according to the equivalent diameter method, which is mathematically defined as GS=(4A/Π)^½, (that is, the square root of 4A/Π), where GS is the grain size and A is the grain area.

Suitably, leaching agents include materials selected from inorganic acids, organic acids, mixtures and derivatives thereof. The particular leaching agent used may depend on such factors as the type of catalyst material used, and the type of other non-diamond metallic materials that may be present in the PCD body. In an example embodiment, suitable leaching agents may include hydrofluoric acid (HF), hydrochloric acid (HCl), nitric acid (HNO3) and mixtures thereof. In one or more embodiments, the PCD body has a microstructure such that it requires at least 3 days under standard conditions, described below, to leach substantially all the catalyst material from the interstitial regions in the PCD body in the first region, to a depth of 300 microns.

In one or more embodiments, one or more cutting elements of the present disclosure (first cutting elements) may be positioned on the bit alone or in combination with one or more second cutting elements which are different (i.e., not in accordance with the cutting elements of the present disclosure). The cutting elements of the present disclosure may be positioned in one or more areas of the drill bit which will benefit the most from the improved properties/performance of such cutting elements. Such areas of the drill bit may include the nose region, shoulder region and/or gage region of the drill bit. In one or more embodiments, the cutting elements of the present disclosure may be positioned on the drill bit as primary cutting elements in the nose, shoulder and/or gage regions while the second cutting elements may be positioned on the drill bit as back-up cutting elements in these regions as well as primary cutting elements in the cone region. In one or more embodiments, the cutting elements of the present disclosure may be positioned on the drill bit as primary cutting elements and as back-up cutting elements in the nose, shoulder and/or gage regions of the drill bit while the second cutting elements may be positioned as primary cutting elements in the cone region.

Figure 11:
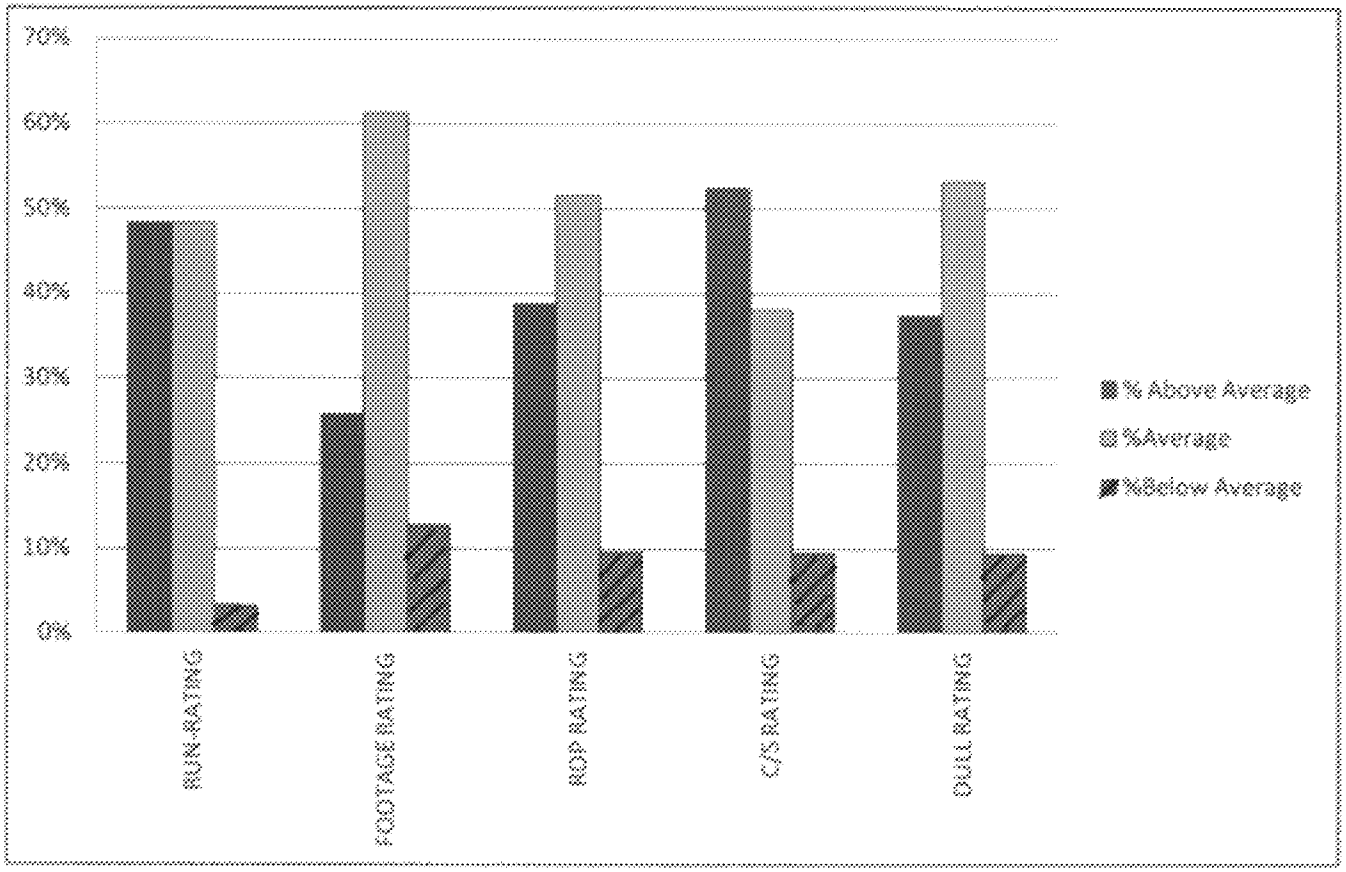
FIG. 11 is a diagram of the results of comparative field testing of cutting element including PCD bodies according to an embodiment of the present disclosure.

According to an embodiment of the disclosure, cutting elements with PCD bodies having high diamond frame strength were incorporated into drill bits and field tested for performance ratings. The results of the field testing is shown in FIG. 11. The data for this figure was compiled from 31 bit runs, which were tested by drilling the bits to 14,000 feet at rates of 30-70 feet/hour. The state of the drill bits and the cutting elements on the drill bit was assessed and compared to a prior bit with a standard PCD cutter. This prior PCD cutter included a PCD body with similar diamond grain size, HPHT sintered at a lower pressure than the tested cutters, and leached. The 31 tested drill bits included cutting elements with PCD bodies exhibiting a leached average flexural strength of 1335±110 MPa. These PCD bodies included an average starting particle size of 9 μm, and a PSD similar to PCD E (shown in Table 2 above). The PCD bodies were HPHT sintered at a sintering pressure of 70-72 kbar.

FIG. 11 shows the results of the field testing. A drill bit was determined to be "Average" for a particular parameter if it matched the performance of the prior, comparative cutter. The number of bits coming at Average, Above Average, and Below Average was noted for each performance parameter. The performance parameters in FIG. 11 include the following: Run-Rating (overall combined performance); Footage Rating (distance traveled, i.e., drilling depth), Rate of Penetration (ROP) Rating (rate of advancement of the bit into the hole); C/S Rating (quality of the bit cutting structure after drilling); and Dull Rating (wear on individual cutting elements on the drill bit). FIG. 11 shows that in every category, a majority of the tested bits met or exceeded the comparative Average. Only a small percentage of the tested bits resulted in Below Average ratings.

Accordingly, in an embodiment, cutting elements of the present disclosure having high diamond frame strength can drill through an earthen formation for longer periods of time and/or at higher speeds, higher weight on bit (WOB), and/or higher rates of penetration (ROP) than cutting elements known heretofore. According to various embodiments, the cutting elements of the present disclosure can drill through highly abrasive earthen formations (e.g., sandstones and geothermal applications) which were not amenable to drilling with fixed cutter drill bits heretofore.

In one embodiment, a method for determining a wear resistance of a polycrystalline diamond cutting element is provided. The polycrystalline diamond body includes a material microstructure comprising a plurality of bonded-together diamond crystals, and a catalyst material occupying the interstitial regions between the diamond crystals. The method includes dividing the diamond body into first and second portions, and substantially removing the catalyst material from the first portion of the diamond body, such as by leaching. Then, the first portion of the diamond body is subjected to a strength test, such as a 3-point bending test, to determine the flexural strength of the first portion. The method includes selecting the diamond body for wear-resistant applications, such as shear cutting applications, based on an increased flexural strength. In one embodiment, the increased flexural strength of the first portion of the diamond body is at least 1300 MPa. The increased flexural strength identifies an increased wear resistance at elevated temperatures.

In one embodiment, a method for increasing a wear resistance of a polycrystalline diamond body is provided. A mixture of diamond particles is obtained and HPHT sintered in the presence of a catalyst material to form PCD. To increase the wear resistance of the PCD, the method includes increasing the diamond frame strength of the PCD to at least 1300 MPa. The diamond frame strength can be increased by increasing the sintering pressure to at least 7.0 GPa, and/or by reducing the average particle size of the diamond particles in the mixture to below 16 microns. The increased diamond frame strength identifies an increased wear resistance of the PCD at elevated temperatures.

While the present disclosure has been described with respect to a limited number of embodiments, those skilled in the art, having benefit of this disclosure, will appreciate that other embodiments and modifications can be devised which do not materially depart from the scope of the invention as disclosed herein. All such embodiments and modifications are intended to be included within the scope of this disclosure as defined in the following claims.

What is claimed is:

1. A cutting element comprising:

a polycrystalline diamond body comprising:

an interface surface;

a top surface opposite the interface surface;

a cutting edge meeting the top surface; and a material microstructure comprising a plurality of bonded-together diamond crystals and interstitial regions between the diamond crystals, the microstructure having a first region that includes at least a portion of the cutting edge, and wherein the first region comprises a diamond frame strength of about 1200 MPa or greater.

2. The cutting element of claim 1, wherein the diamond frame strength of the first region is about 1300 MPa or greater.

3. The cutting element of claim 2, wherein the first region comprises a sintered average grain size less than 10 microns.

4. The cutting element of claim 2, wherein the first region comprises a sintered average grain size less than 7 microns.

5. The cutting element of claim 2, wherein the first region comprises a sintered average grain size in the range of 5-6 microns.

6. The cutting element of claim 5, wherein a second region of the microstructure proximate the interface surface comprises a plurality of the interstitial regions comprising the catalyst material disposed therewithin.

7. The cutting element of claim 2, wherein the first region comprises a plurality of the interstitial regions that are substantially free of a catalyst material, and wherein the first region extends from the cutting edge to a depth of at least 300 microns.

8. The cutting element of claim 2, wherein the microstructure exhibits a drop in compressive stress of up to 25% after leaching, at room temperature.

9. The cutting element of claim 2, wherein the diamond volume fraction in the first region is greater than 91%.

10. The cutting element of claim 2, wherein the first region extends along the entire cutting edge of the cutting element.

11. The cutting element of claim 2, wherein the first region extends along at least a critical zone of the polycrystalline diamond body.

12. The cutting element of claim 2, wherein the first region extends along the entire top surface, the cutting edge, and at least a portion of a side surface.

13. The cutting element of claim 2, wherein the first region comprises the entire polycrystalline diamond body.

14. The cutting element of claim 13, further comprising a substrate bonded to the interface surface.

15. The cutting element of claim 2, comprising a catalyst material in at least a portion of the microstructure, and wherein the polycrystalline diamond body has a strength of about 1500 MPa or greater.

16. The cutting element of claim 1, wherein the interface comprises at least a non-aggressive progression having a height to width ratio less than 0.7.

17. A cutting element comprising:

a substrate; and a polycrystalline diamond body formed over the substrate, the polycrystalline diamond body comprising:

an interface surface meeting the substrate at an interface;

a top surface opposite the interface surface;

a cutting edge meeting the top surface; and a material microstructure comprising a plurality of bonded-together diamond crystals and interstitial regions between the diamond crystals, wherein a first region of the microstructure proximate the top surface has a diamond frame strength of about 1300 MPa or greater and an average sintered grain size of less than 10 microns.

18. The cutting element of claim 17, wherein the interface comprises a non-aggressive shape having a height to diameter ratio of zero to 0.1.

19. The cutting element of claim 18, wherein the substrate comprises a cobalt content less than or equal to approximately 11% by weight.

20. The cutting element of claim 17, wherein the first region of the microstructure comprises a plurality of the interstitial regions that are substantially free of a catalyst material, and further comprising a second region of the microstructure proximate the interface surface comprising a plurality of the interstitial regions comprising the catalyst material disposed therewithin.

21. The cutting element of claim 17, wherein the first region comprises an average sintered grain size less than 7 microns.

22. The cutting element of claim 17, wherein the interface comprises a non-aggressive shape having a height to diameter ratio of zero to 0.1.

23. The cutting element of claim 17, wherein the interface comprises at least a non-aggressive progression having a height to width ratio less than 0.7.

24. A cutting element comprising:

a substrate having an interface surface with a height to diameter ratio between 0 and 0.1 and a cobalt content less than 11%; and a polycrystalline diamond body formed over the interface surface of the substrate, the polycrystalline diamond body comprising:

an interface surface;

a top surface opposite the interface surface;

a cutting edge meeting the top surface; and a material microstructure comprising a plurality of bonded-together diamond crystals and interstitial regions between the diamond crystals, wherein a first region of the microstructure has a diamond frame strength of about 1300 MPa or greater, an average sintered grain size of less than 14 microns, and a diamond volume fraction of at least 93%, wherein the first region incorporates the cutting edge.

25. The cutting element of claim 24, wherein the interface comprises a non-aggressive shape having a height to diameter ratio of zero to 0.1.

26. The cutting element of claim 24, wherein the interface comprises at least a non-aggressive progression having a height to width ratio less than 0.7.

* * * * *